US009171685B2

(12) United States Patent
Henmi

(10) Patent No.: US 9,171,685 B2
(45) Date of Patent: Oct. 27, 2015

(54) POWER SOURCE CIRCUIT SHUTOFF APPARATUS

(71) Applicant: YAZAKI CORPORATION, Minato-ku, Tokyo (JP)

(72) Inventor: Fumitoshi Henmi, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 179 days.

(21) Appl. No.: 13/682,277

(22) Filed: Nov. 20, 2012

(65) Prior Publication Data

US 2013/0126205 A1 May 23, 2013

(30) Foreign Application Priority Data

Nov. 21, 2011 (JP) ..... 2011-253839

(51) Int. Cl.

| | |
|---|---|
| ***H01H 3/04*** | (2006.01) |
| ***H01H 3/06*** | (2006.01) |
| ***H01H 35/00*** | (2006.01) |
| ***H01H 21/22*** | (2006.01) |
| ***H01H 27/00*** | (2006.01) |
| ***H01R 13/629*** | (2006.01) |

(52) U.S. Cl.

CPC ..... *H01H 35/003* (2013.01); *H01H 21/22* (2013.01); *H01H 27/00* (2013.01); *H01R 13/62938* (2013.01)

(58) Field of Classification Search

CPC ..... H01H 35/003; H01H 3/06
USPC ..... 174/561; 200/335
See application file for complete search history.

(56) References Cited

U.S. PATENT DOCUMENTS

| | | | | |
|---|---|---|---|---|
| 6,659,783 | B2 * | 12/2003 | Copper et al. | 439/181 |
| 7,137,844 | B2 | 11/2006 | Flowers et al. | |
| 2002/0173185 | A1 | 11/2002 | Fukushima et al. | |
| 2005/0098419 | A1 * | 5/2005 | Matsui et al. | 200/311 |

(Continued)

FOREIGN PATENT DOCUMENTS

| | | | |
|---|---|---|---|
| CN | 101226833 | A | 7/2008 |
| EP | 2456020 | A1 | 5/2012 |
| JP | 5420364 | U | 2/1979 |

(Continued)

OTHER PUBLICATIONS

Official Action issued on Aug. 5, 2014 in counterpart Chinese application 201210473043.2.

(Continued)

*Primary Examiner* — Jenny L Wagner
*Assistant Examiner* — Michael P McFadden
(74) *Attorney, Agent, or Firm* — Sughrue Mion, PLLC

(57) ABSTRACT

In a power source circuit shutoff apparatus, with the lever rotated from a connector mating start position to a connector mating completion position, a pair of first signal terminals and a pair of second signal terminals are brought into on-state after a pair of first main terminals and a pair of second main terminals are brought into on-state. With the lever rotated from the connector mating completion position to the connector mating start position, a pair of first main terminals and a pair of second main terminal are brought into off-state after a pair of first signal terminals and a pair of second signal terminals are brought into off-state. The pair of first signal terminals and the pair of second signal terminals are each disposed along a straight line extending in a direction perpendicular to a rotational spindle direction of the lever.

5 Claims, 11 Drawing Sheets

(56) References Cited

U.S. PATENT DOCUMENTS

| | | | | |
|---|---|---|---|---|
| 2008/0185276 | A1* | 8/2008 | Matsunaga et al. | 200/335 |
| 2009/0047812 | A1* | 2/2009 | Deno et al. | 439/157 |

FOREIGN PATENT DOCUMENTS

| | | | |
|---|---|---|---|
| JP | 2002-298704 | A | 10/2002 |
| JP | 2003100385 | A | 4/2003 |
| JP | 2003100386 | A | 4/2003 |

OTHER PUBLICATIONS

Communication dated Jun. 30, 2015 from the Japanese Patent Office in counterpart application No. 2011-253839.

* cited by examiner

POWER SOURCE CIRCUIT SHUTOFF APPARATUS

CROSS REFERENCE TO RELATED APPLICATION

This application claims benefit of priority under 35 U.S.C. §119 to Japanese Patent Application No. 2011-253839, filed on Nov. 21, 2011, the entire contents of which are incorporated by reference herein.

BACKGROUND OF THE INVENTION

1. Field of the Invention

The present invention relates to a power source circuit shutoff apparatus for connecting and shutting off a power source circuit by mating and separating connector housings equipped with a lever.

2. Description of the Related Art

Conventionally, in electric vehicles (EV) or hybrid electric vehicles (HEV), there is proposed a power source circuit shutoff apparatus (service plug) for shutting off an energizing between a power source portion and a load so as to secure operational safety in such occasions as maintenance of an electric system (for example, refer to Patent Literature 1 (Japanese Patent Unexamined Publication No. 2002-298704)).

As a power source circuit shutoff apparatus, the present inventor has proposed one shown in FIG. 1 to FIG. 4. Specifically, as shown in FIG. 1 to FIG. 3, a power source circuit shutoff apparatus 100 is provided with a first connector housing 110, a second connector housing 120 configured to be mated with and separated from the first connector housing 110, and a lever 130 rotatably provided at the second connector housing 120 and configured to cause a mating force or a separating force to the first connector housing 110 and the second connector housing 120 by rotation.

A pair of cam pins 111 are protrudingly provided on respective side faces of the first connector housing 110. A pair of first main terminals 113 (refer to FIG. 2) are disposed in a connector mating chamber 110*a* provided at the first connector housing 110. A pair of first signal terminals 116 are disposed in an external hood portion 115 provided at the first connector housing 110.

A pair of rotational shafts 121 (refer to FIG. 1) are protrudingly provided on respective side faces of the second connector housing 120. A pair of second main terminals 122 (refer to FIG. 3) each of which is configured to be mated with and separated from one of the pair of first main terminals 113 are provided in the second connector housing 120.

A pair of rotation receiving grooves 131 are formed on respective side faces of the lever 130. Each of the pair of rotational shafts 121 of the second connector housing 120 is pivotally supported to one of the pair of rotation receiving grooves 131. By this configuration, the lever 130 is rotatably supported on the second connector housing 120. Further, a pair of cam grooves 132 are provided on respective side faces of the lever 130. Each of a pair of cam pins 111 of the first connector housing 110 is inserted into one of the pair of cam grooves 132. A pair of second signal terminals 134 are disposed in a hood portion 133 provided at a side face portion of the lever 130.

A main circuit switch (not shown) includes the first main terminals 113 and the second main terminals 122. On the other hand, a signal circuit switch (not shown) includes the first signal terminals 116 and the second signal terminals 134.

Hereinafter, a conducting operation of a power source circuit of the power source circuit shutoff apparatus 100 will be explained. The second connector housing 120 is inserted into a connector mating chamber (not shown) of the first connector housing 110 and the cam pin 111 is inserted into an inlet of the cam groove 132 of the lever 130. The first connector housing 110 and the second connector housing 120 are brought into a connector mating start state.

Rotating the lever 130 from a connector mating start position to a connector mating completion position side moves the cam pin 111 in the cam groove 132, to thereby cause the mating force to the first connector housing 110 and the second connector housing 120 such that the second connector housing 120 is gradually inserted into the connector mating chamber of the first connector housing 110. Then, the pair of first main terminals 113 and the pair of second main terminals 122 are brought into a contact state. This operation turns on the main circuit switch (not shown) in a connector mating operation position.

Further rotating of the lever 130 gradually brings the pair of first signal terminals 116 and the pair of second signal terminals 134 into contact with each other, thereby causing a complete contact state in the operation completion position of the lever 130. This operation turns on a signal circuit switch (not shown) in the operation completion position of the lever 130. In the power source circuit shutoff apparatus 100, it is not until the pair of the signal terminals are brought into the on-state after the pair of the main terminals are brought into the on-state, that the power source circuit (not shown) is brought into the conduction state.

Further, the power shutoff operation of the power source circuit shutoff apparatus 100 can be implemented by operating the lever 130 in a reverse order of that stated above. This operation allows the power source circuit shutoff apparatus 100 to shutoff the power source circuit (not shown) at the time point when the first signal terminal 116 and the second signal terminal 134 are turned off, thus enabling to prevent occurrence of an arc discharge at the subsequent time point for switching the first main terminal 113 and second main terminals 122 to the off-state.

By the way, each of the pair of first signal terminals 116 and the pair of second signal terminals 134 are disposed along a rotational spindle direction of the lever 130 with an interval from each other, as shown in FIG. 2 and FIG. 3. Specifically, each of the pair of first signal terminals 116 is in a form of a female terminal. On the other hand, each of the pair of second signal terminals 134 is in a form of a male terminal. The pair of second signal terminals 134 are, as shown in FIG. 4, provided to be integrated with each other by a connecting plate portion 135 and are so bent by the connecting plate portion 135 as to be opposedly disposed.

With the power source circuit shutoff apparatus 100, however, each of the pair of first signal terminals 116 and the pair of second signal terminals 134 are disposed in the rotational spindle direction of the lever 130 with an interval from each other. By this configuration, when the lever 130 is rotated from the connector mating start position to the connector mating completion position, the pair of second signal terminals 134 opposed to each other simultaneously contact the pair of first signal terminals 116. Thus, the pair of second signal terminals 134 contacting the pair of first signal terminal 116 increase a power for rotating the lever 130, thus causing such a fear as that the operability of the lever 130 may be lowered.

SUMMARY OF THE INVENTION

It is an object of the present invention to provide a power source circuit shutoff apparatus capable of improving the operability of a lever.

For solving the above problem, according to a first feature of the present invention, there is provided a power source circuit shutoff apparatus (power source circuit shutoff apparatus 1) including: a first connector housing (first connector housing 10) having a pair of first main terminals (first main terminals 13) and a pair of first signal terminals (first signal terminals 16); a second connector housing (second connector housing 20) having a pair of second main terminals (second main terminals 23) configured to be mated with and separated from the pair of the first main terminals, the second connector housing being configured to be mated with and separated from the first connector housing; a lever (lever 30) having a pair of second signal terminals (second signal terminal 40) configured to be mated with and separated from the pair of the first signal terminals, the lever being rotatably provided at the second connector housing and configured to cause a mating force and a separating force to the first connector housing and the second connector housing by a rotation; wherein with the lever rotated from a connector mating start position to a connector mating completion position, after the pair of the first main terminals and the pair of the second main terminals are brought into an on-state, the pair of the first signal terminals and the pair of the second signal terminal are brought into an on-state, with the lever rotated from the connector mating completion position to the connector mating start position, after the pair of the first signal terminals and the pair of the second signal terminals are brought into an off-state, the pair of the first main terminals and the pair of the second main terminal are brought into an off-state, the pair of the first signal terminals are disposed along a straight line (straight line L) extending in a direction perpendicular to a rotational spindle direction of the lever with an interval from each other, and the pair of the second signal terminals are disposed along the straight line (straight line L) with an interval from each other.

According to the first feature, each of the pair of first signal terminals and the pair of second signal terminals are disposed along the straight line extending in the direction perpendicular to the rotational spindle direction of the lever with the interval from each other. Thus, when the lever rotates from the connector mating start position to the connector mating completion position, the one of the first signal terminals and the one of the second signal terminals are brought into contact with each other and then the other of the first signal terminals and the other of the second signal terminals are brought into contact with each other. This can disperse the force for rotating the lever, thus enabling to improve the operability of the lever 30.

Further, with the lever rotated from the connector mating completion position to the connector mating start position, the contact between the other of the first signal terminals and the other of the second signal terminals is canceled, and then the contact between the one of the first signal terminals and the one of the second signal terminal is canceled. This allows the signal circuit switch (SW2), which includes the pair of first signal terminals and the pair of second signal terminals, to be more rapidly brought into the off-state. Thus, an arc discharge caused between the pair of first main terminals and the pair of second main terminals can be suppressed.

According to a second feature of the present invention, the pair of the first signal terminals are disposed in a line-up manner along the straight line, and the pair of the second signal terminals are disposed in a line-up manner along the straight line.

According to the second feature, the pair of first signal terminals and the pair of second signal terminals each are disposed in a line-up manner along the straight line extending in the direction perpendicular to the rotational spindle direction of the lever. This eliminates the need of bending the pair of second signal terminals, unlike the conventional technology, and can shorten the length (connecting portion) between the pair of second signal terminals, thus enabling to reduce the production cost of the pair of second signal terminals.

According to a third feature of the present invention, the pair of the first main terminals are disposed along the straight line with an interval from each other, and the pair of the second main terminals are disposed along the straight line with an interval from each other.

According to the third feature, each of the pair of first main terminals and the pair of second main terminals are disposed along the straight line extending in the direction perpendicular to the direction of the rotational spindle direction of the lever with the interval from each other. This can narrow the width of each of the first connector housing and the second connector housing relative to the rotational spindle direction of the lever, thus enabling to increase a degree of freedom of the power source circuit shutoff apparatus.

According to a fourth feature of the present invention, the lever includes an operation portion (operation portion 33) capable of operating the rotation of the lever, and the operation portion is provided closer to a rotational distal end side than to a position of the pair of the second signal terminals.

According to the fourth feature, the operating portion is provided closer to the rotational distal end side than to the position of the pair of second signal terminals. This can narrow the width of the lever relative to the rotational spindle direction of the lever, thus increasing the degree of freedom of the power source circuit shutoff apparatus.

According to a fifth feature of the present invention, the lever includes an operation portion capable of operating the rotation of the lever, and the operation portion is provided on a lateral side in a position of the pair of the second signal terminals.

According to the fifth feature, the operating portion is provided on the lateral side of the pair of second signal terminals. This can shorten the length of the lever relative to the direction perpendicular to the rotational spindle direction of the lever, thus enabling to increase the degree of freedom of the power source circuit shutoff apparatus.

The features of the present invention can provide a power source circuit shutoff apparatus capable of improving the operability of a lever and reducing the production cost of a pair of second signal terminals.

DESCRIPTION OF THE EMBODIMENTS

Figure 1:
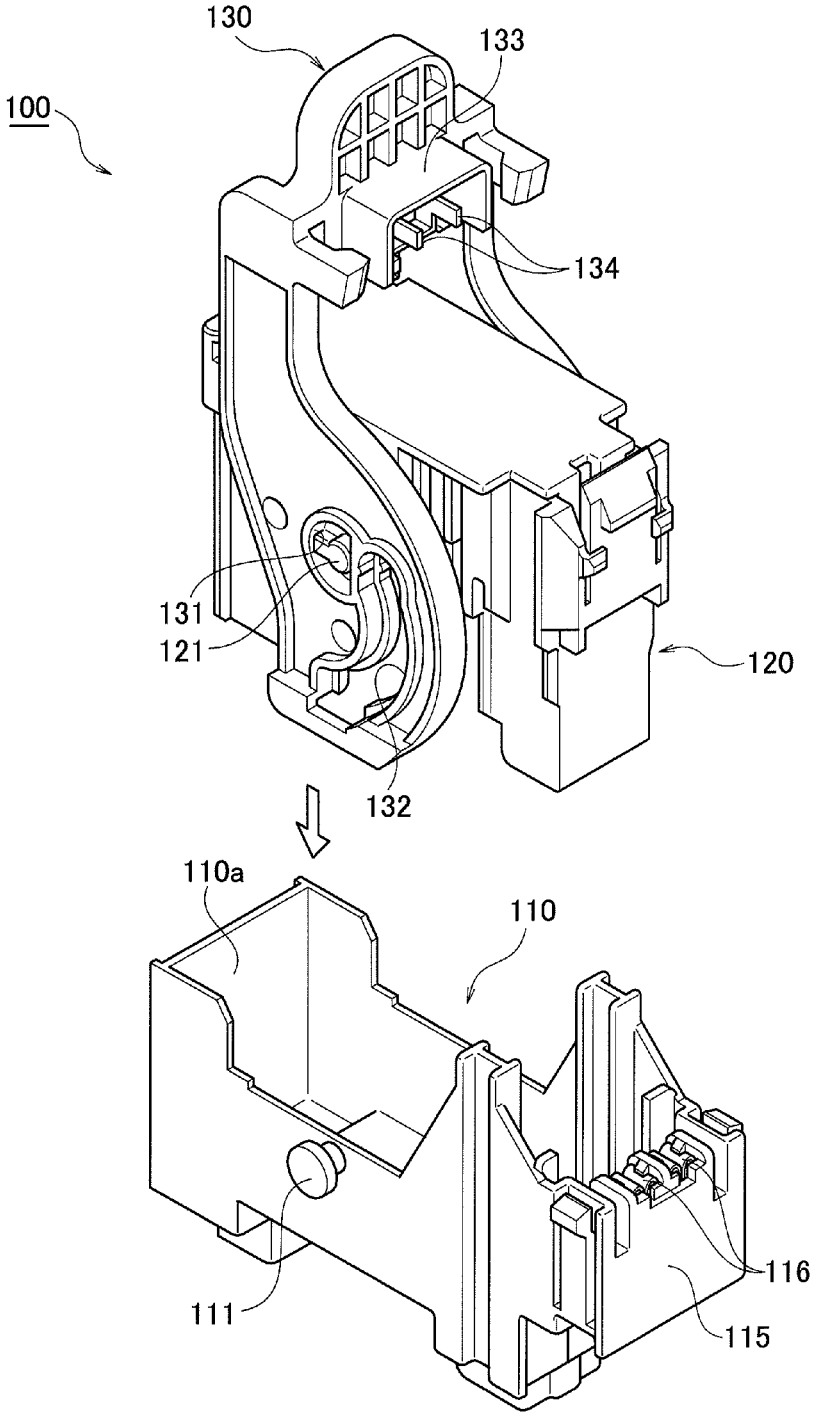
FIG. 1 is an exploded perspective view of a power source circuit shutoff apparatus 100 according to a related art.
Figure 2:
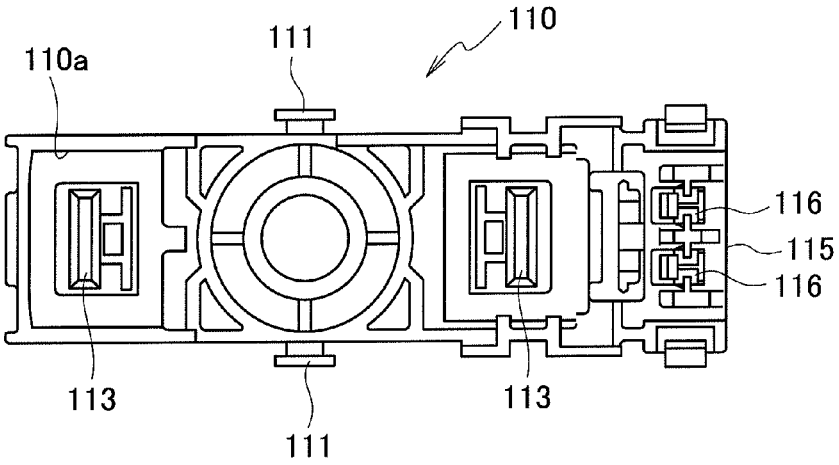
FIG. 2 is a plan view of a first connector housing 110 according to the related art.
Figure 3:
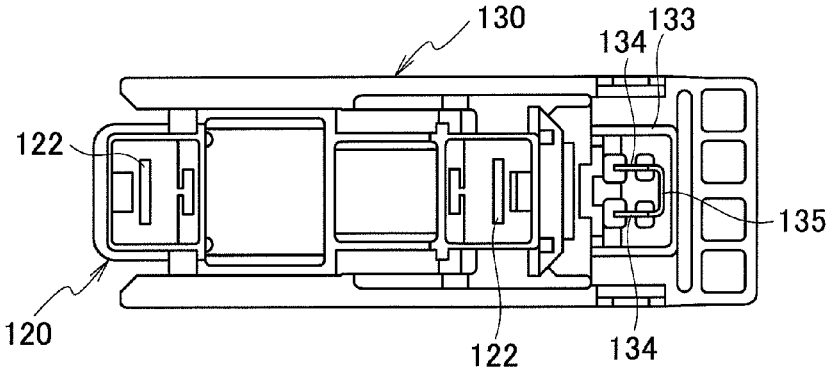
FIG. 3 is a plan view of a part (near a second signal terminal 134) of a lever 130 according to the related art.
Figure 4:
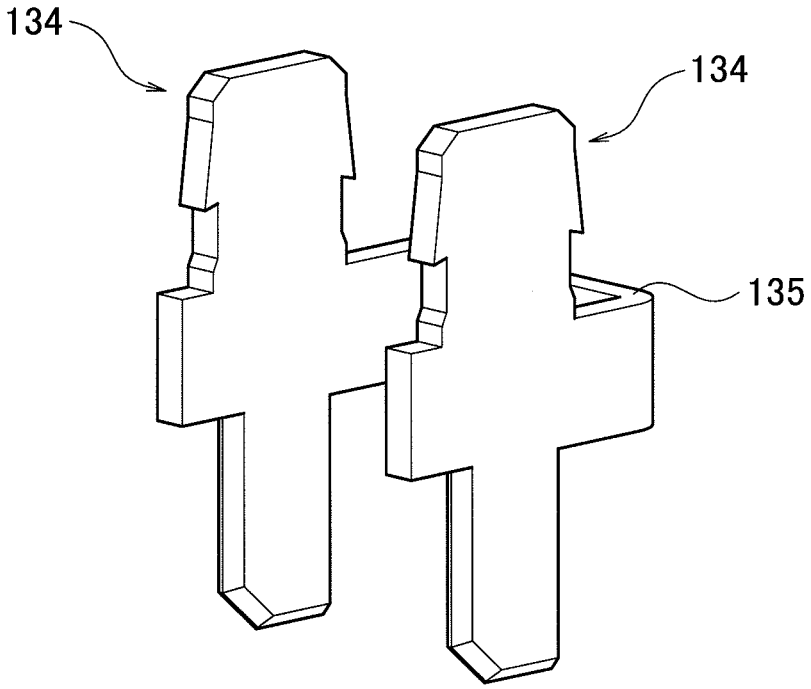
FIG. 4 is a perspective view of a second signal terminal 134 according to the related art.

Hereinafter, a power source circuit shutoff apparatus according to an embodiment of the present invention will be explained with reference to drawings. Specifically, an explanation will be made about (1) structure of the power source circuit shutoff apparatus, (2) structure of signal terminals, (3) structure of main terminals, (4) structure of a power source circuit, (5) operations and effects, (6) modified example, and (7) other embodiments.

Further, in the description of the following drawings, same or similar reference numerals or signs will be assigned to same or similar portions. However, since the drawings are schematic, ratios and the like of respective dimensions are different from those of actual ones.

Thus, specific dimensions and the like should be determined in view of the following explanations. Further, in the drawings, portions having different dimensional relations or different dimensional ratios are included.

(1) Structure of Power Source Circuit Shutoff Apparatus

Figure 5:
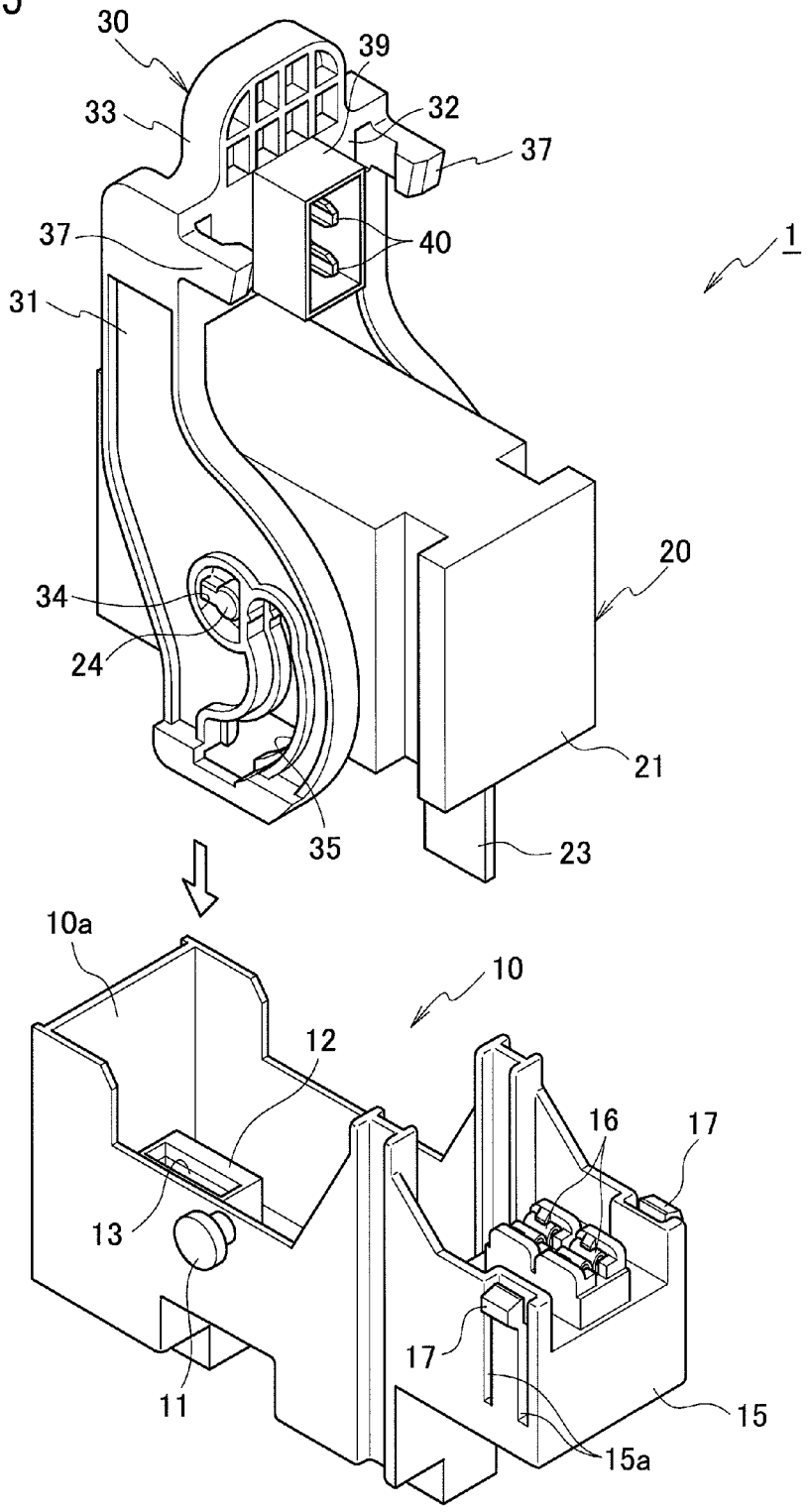
FIG. 5 is an exposed perspective view of a power source circuit shutoff apparatus 1 according to an embodiment of the present invention.
Figure 6:
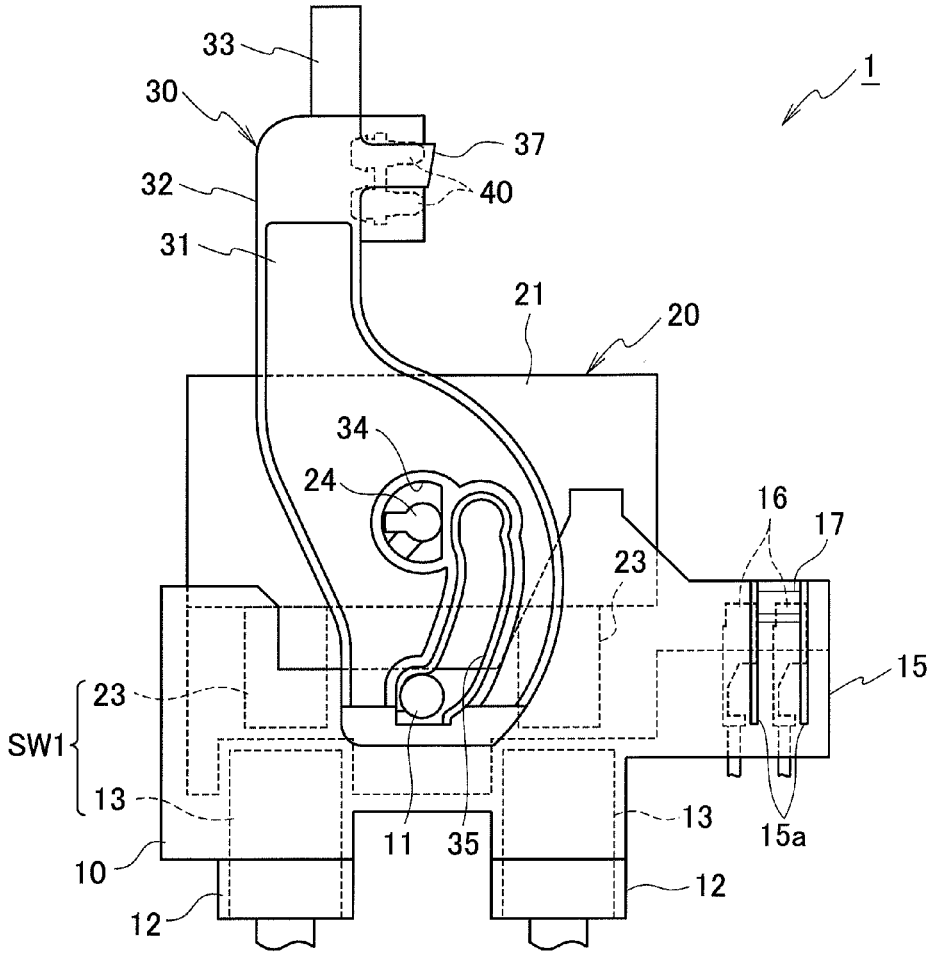
FIG. 6 is a side view showing a state before mating a first connector housing 10 with a second connector housing 20 according to the embodiment of the present invention.
Figure 7:
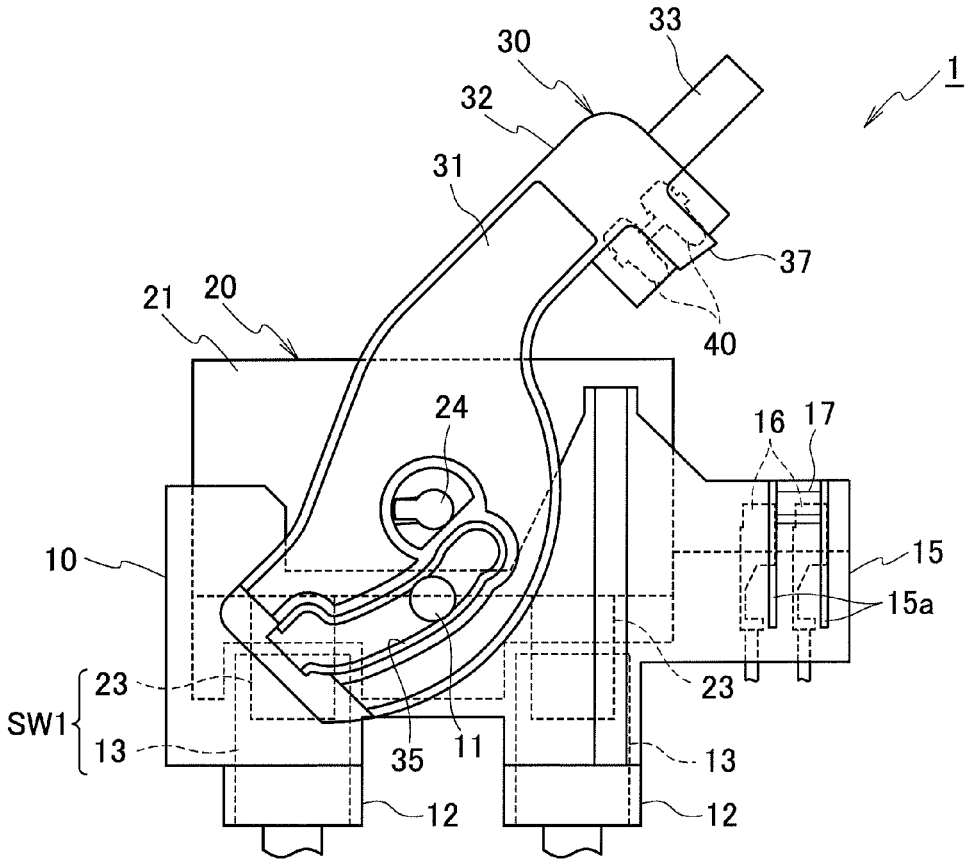
FIG. 7 is a side view showing a midway state of mating the first connector housing 10 with the second connector housing 20 according to the embodiment of the present invention.
Figure 8:
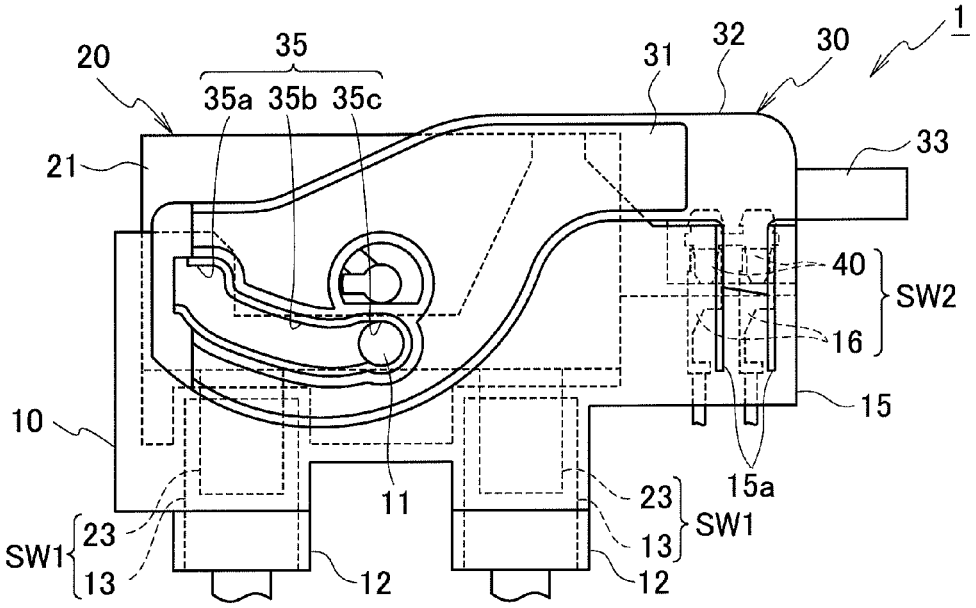
FIG. 8 is a side view showing a state that the first connector housing 10 are mated with the second connector housing 20 according to the embodiment of the present invention.

First, the structure of the power source circuit shutoff apparatus 1 according to the embodiment will be explained with reference to the drawings. FIG. 5 is an exploded perspective view of the power source circuit shutoff apparatus 1 according to the embodiment. FIG. 6 is a side view showing a state before mating a first connector housing 10 with a second connector housing 20 according to the embodiment. FIG. 7 is a side view showing a midway state of mating the first connector housing 10 with the second connector housing 20 according to the embodiment. FIG. 8 is a side view showing a state that the first connector housing 10 are mated with the second connector housing 20 according to the embodiment.

As shown in FIG. 5 to FIG. 8, the power source circuit shutoff apparatus 1 is provided with a first connector housing 10, a second connector housing 20 configured to be mated with and separated from the first connector housing 10, and a lever 30 rotatably provided at the second connector housing 20 and configured to cause a mating force or a separating force to the first connector housing 10 and the second connector housing 20 by rotation.

A pair of cam pins 11 are protrudingly provided on respective side faces of the first connector housing 10. The first connector housing 10 has a connector mating chamber 10*a* having an upper face opened. Two internal terminal hood portions 12 are provided in the connector mating chamber 10*a*. A pair of first main terminals 13 each as a female terminal are provided in the respective internal terminal hood portions 12.

The first connector housing 10 has an external terminal hood portion 15 provided outside the connector mating chamber 10*a*. The external terminal hood portion 15 has an upper portion opened. A pair of first signal terminals 16 each as a female terminal are provided in the external terminal hood portion 15.

A pair of first locked portions 17 are protrudingly provided on respective side walls of the external terminal hood portion 15. The first locked portion 17 is so configured as to be saggingly deformed with ease by a pair of slits 15*a* on a side wall of the external terminal hood portion 15.

The second connector housing 20 is provided with a housing body 21 receiving therein a fuse (not shown). This housing body 21 has such a dimension and a configuration as to be capable of being mated with and separated from the connector mating chamber 10*a* and the external terminal hood portion 15 of the first connector housing 10. The housing body 21 is provided with a pair of second main terminals 23 each configured to be mated with and separated from one of the pair of first main terminals 13 and each formed into a plate body as a male terminal. A pair of rotational spindles 24 are protrudingly provided on respective side faces of the housing body 21.

Each of the second main terminals 23 protrudes downward from the housing body 21. The second main terminals 23 are connected with each other via a fuse (not shown). Further, the pair of first main terminals 13 of the first connector housing 10 and the pair of second main terminals 23 on the second connector housing 20 constitute a main circuit switch SW1.

The lever 30 is provided with a pair of arm plate portions 31, a connecting portion 32 for connecting the pair of arm plate portions 31 with each other at respective rotational distal end sides, and an operating portion 33 capable of operating rotation of the lever 30.

Each of a pair of arm plate portions 31 is provided with one of a pair of rotation receiving portions 34. Each of a pair of rotational spindles 24 is pivotally supported by one of the pair of rotation receiving portions 34. This configuration allows the lever 30 to be rotatably supported on the second connector housing 20. Each of a pair of cam grooves 35 is formed at one of the arm plate portions 31. Each of a pair of first locking portions 37 is disposed at a rotational distal end side of and in a lower position of one of the pair of arm plate portions 31.

A cam pin 11 of the first connector housing 10 is inserted into each of the pair of cam grooves 35. As shown in FIG. 8, the cam groove 35 has an entry straight portion 35*a* into which the cam pin 11 can enter, a curved portion 35*b* communicating with the entry straight portion 35*a* and having a distance gradually variable from a center of the rotation receiving portion 34, and a circular arc portion 35*c* communicating with the curved portion 35*b* and having a constant distance from the center of the rotation receiving portion 34.

With the cam pin 11 moving in the cam groove 35, the lever 30 rotates from the connector mating start position of the lever 30 to the connector mating completion position via the connector mating operation position. Further, in the connector mating start position, the cam pin 11 is positioned in the entry straight portion 35*a* (refer to FIG. 6). In the connector mating operation position, the cam pin 11 is positioned in a boundary position between the curved portion 35*b* and the circular arc portion 35*c* (refer to FIG. 7). In the connector mating completion position, the cam pin 11 is positioned in the innermost position of the circular arc portion 35*c* (refer to FIG. 8).

That is, in the rotating process of the lever 30 between the connector mating start position and the connector mating operation position, the cam pin 11 is moveable in the curved portion 35*b*, thus causing the mating force or the separating force to the first connector housing 10 and the second connector housing 20. This operation moves the first connector housing 10 and the second connector housing 20 in the mating direction or the separating direction.

Further, with the lever 30 in the connector mating completion position, the cam pin 11 is positioned in the circular arc portion 35*c*, thus failing to cause the mating force or the separating force to the first connector housing 10 and the second connector housing 20, thereby preventing the movement of the first connector housing 10 and second connector housing 20 in the mating direction or the separating direction.

A hood portion 39 is provided in the lower portion of the operating portion 33. The hood portion 39 is opened downward. A pair of second signal terminals 40 configured to be mated with and separated from the pair of first signal terminals 16 and each formed into a plate as a male terminal are provided in the hood portion 39. The operating portion 33 is provided closer to a rotational distal end side than to the position of the pair of the second signal terminal 40. Further, the pair of first signal terminals 16 of the first connector housing 10 side and the pair of second signal terminals 40 of the lever 30 side constitute a signal circuit switch SW2 (refer to FIG. 8).

(2) Structure of Signal Terminals

Figure 9:
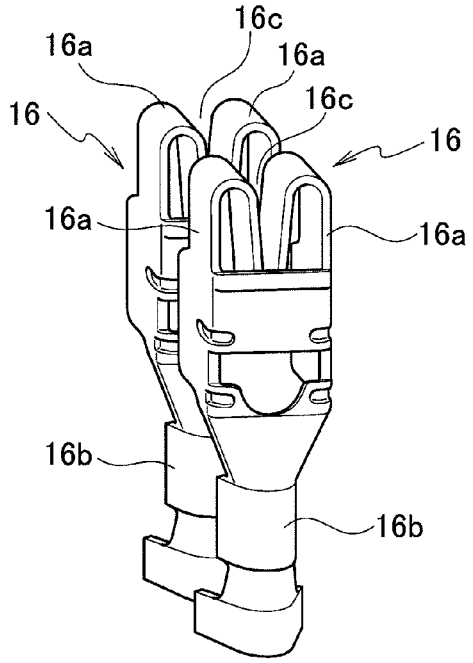
FIG. 9 is a perspective view of a first signal terminal 16 according to the embodiment of the present invention.
Figure 10:
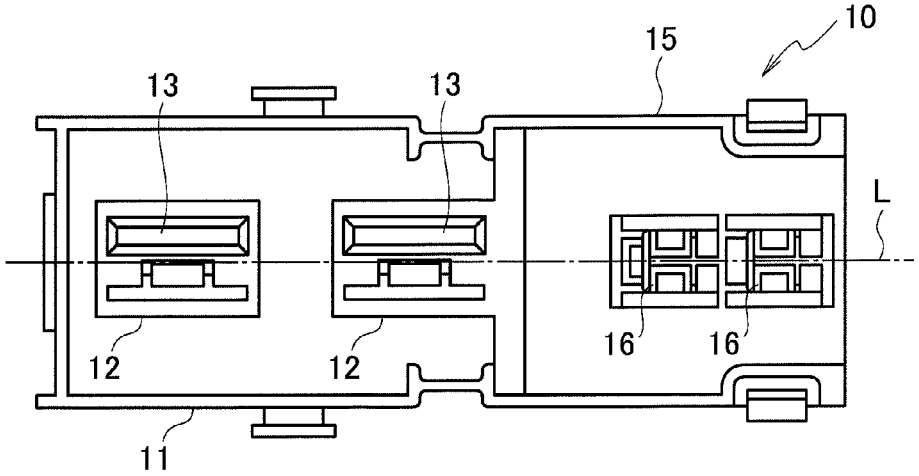
FIG. 10 is a plan view of the first connector housing (near the first signal terminal 16) according to the embodiment of the present invention.
Figure 11A:
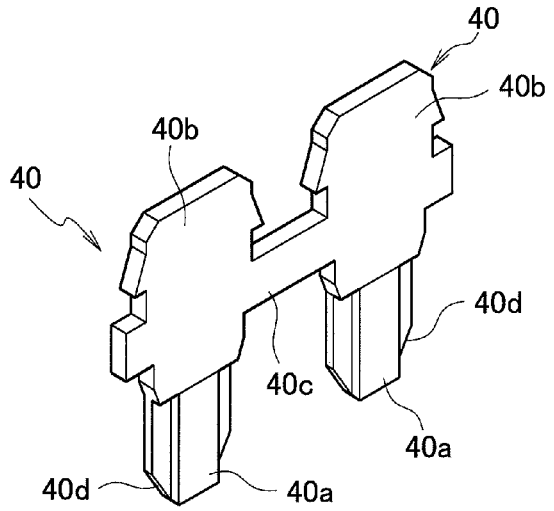
FIG. 11A is a perspective view of a second signal terminal 40 according to the embodiment of the present invention.
Figure 11B:
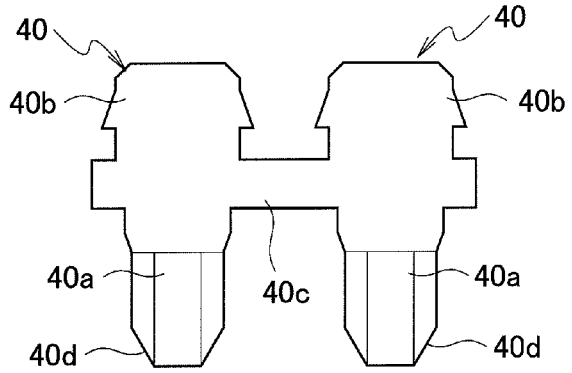
FIG. 11B is a front view of the second signal terminal 40 according to the embodiment of the present invention.
Figure 12:
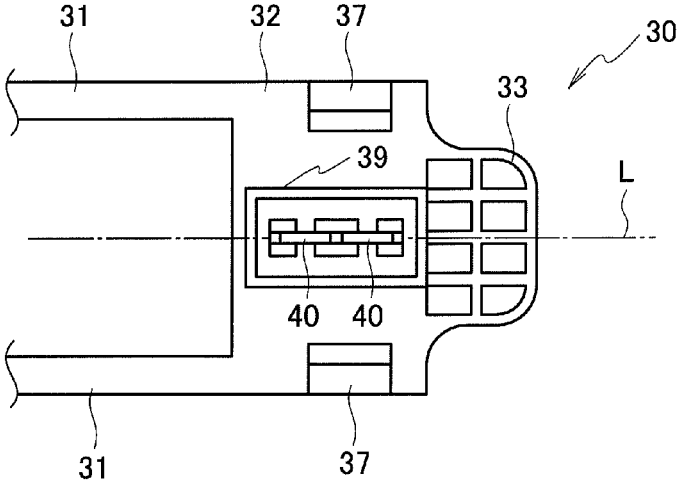
FIG. 12 is a plan view of a part (near the second signal terminal 40) of a lever 30 according to the embodiment of the present invention.

Next, the structure of the first signal terminal 16 and the second signal terminal 40 will be explained with reference to the drawings. FIG. 9 is a perspective view of the first signal terminal 16 according to the embodiment. FIG. 10 is a plan view of the first connector housing 10 (near the first signal terminal 16) according to the embodiment. FIGS. 11A and 11B are respectively a perspective view and a front view of the second signal terminal 40 according to the embodiment. FIG. 12 is a plan view of a part (near the second signal terminal 40) of the lever 30 according to the embodiment.

As shown in FIG. 9, each first signal terminal 16 is provided with a pair of plate spring contacts 16*a* and an electric wire crimping portion 16*b* integrally connected with the pair of plate spring contacts 16*a*. The pair of plate spring contacts 16*a* each have a distal end side bent inward in a form of a substantial R-letter shape, and an opening 16*c* is formed between the bent portions of the plate spring contacts 16*a* and has a wide inlet side and a narrow back side.

The pair of first signal terminals 16 (the openings 16*c*) are, as shown in FIG. 10, disposed in a line-up manner along a straight line L extending in a direction perpendicular to the rotational spindle direction of the lever 30 with an interval from each other.

On the other hand, as shown in FIGS. 11A and 11B, each second signal terminal 40 is provided with a tab-shaped contact 40*a* and a support portion 40*b* connected to be integrated with the tab-shaped contact 40*a*. The support portions 40*b* are connected with each other by a connecting portion 40*c*. An edge portion disposed at a distal end of the tab-shaped contact 40*a* and configured to have a first contact with the first signal terminal 16 is formed as a taper face 40*d*.

So as to be mated with and separated from the pair of first signal terminals 16, as shown in FIG. 12, the pair of second signal terminals 40 are disposed in a line-up manner along the straight line L extending in the direction perpendicular to the rotational spindle direction of the lever 30 with the interval from each other. Specifically, the pair of second signal terminals 40 are disposed in a line-up manner on the straight line L with the interval from each other such that a width direction of the pair of second signal terminals 40 is along the straight line L. The pair of first signal terminals 16 are disposed in a line-up manner on the straight line L with the interval from each other such that the pair of first signal terminals 16 can receive the pair of second signal terminals 40 disposed in the above manner.

(3) Structure of Main Terminals

Next, the structure of the first main terminal 13 and the second main terminal 23 will be explained with reference to the drawings.

As shown in FIG. 10, the pair of first main terminals 13 (an opening into which the second main terminal 23 is inserted) are disposed along the straight line L extending in the direction perpendicular to the rotational spindle direction of the lever 30 with the interval from each other.

On the other hand, as shown in FIGS. 5 to 8 and the like, the pair of second main terminals 23 are disposed, so as to be mated with and separated from the pair of first main terminals 13, along the straight line L (refer to FIG. 12) extending in the direction perpendicular to the rotational spindle direction of the lever 30 with the interval from each other. Specifically, the pair of second main terminals 23 are disposed in a line-up manner on the straight line L with the interval from each other such that a width direction of the pair of second main terminals 23 is along the straight line L. The pair of first main terminals 13 are disposed in a line-up manner on the straight line L with the interval from each other such that the pair of first main terminals 13 can receive the pair of second main terminals 23 disposed in the above manner.

(4) Structure of Power Source Circuit

Next, the structure of the power source circuit associated with the power source circuit shutoff apparatus 1 will be briefly explained. A relay (not shown) to be turned on and off by the signal circuit switch SW2, and the main circuit switch SW1 are connected in series between the power source portion (not shown) and the load portion (not shown). Thus, the main circuit switch SW1 and the signal circuit switch SW2 turned on together bring the power source circuit into an on-state. In other switch conditions, the power source circuit is in an off-state.

(4.1) Operation of Power Source Circuit

Figure 13:
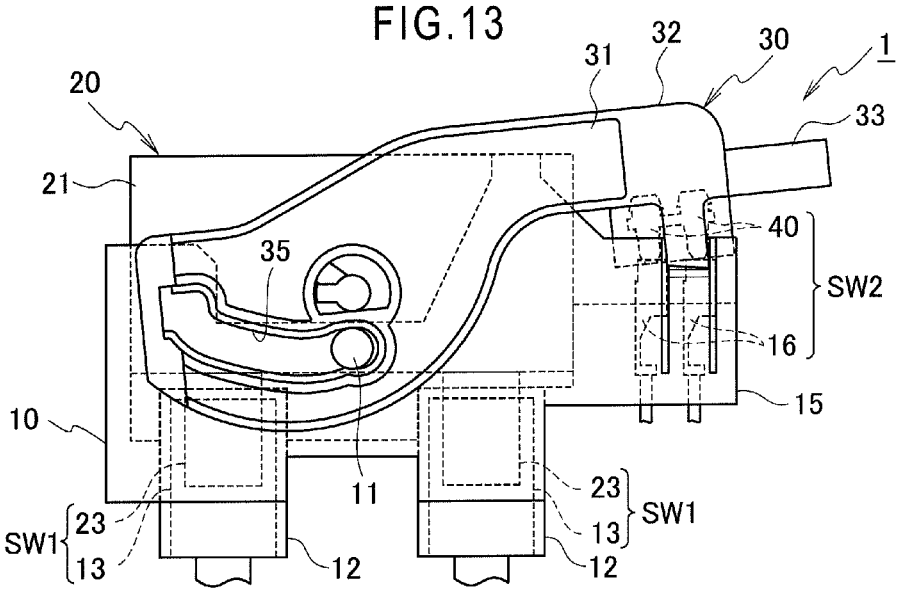
FIG. 13 is a side view showing a state immediately before the first signal terminal 16 is mated with the second signal terminal 40 according to the embodiment of the present invention.
Figure 14:
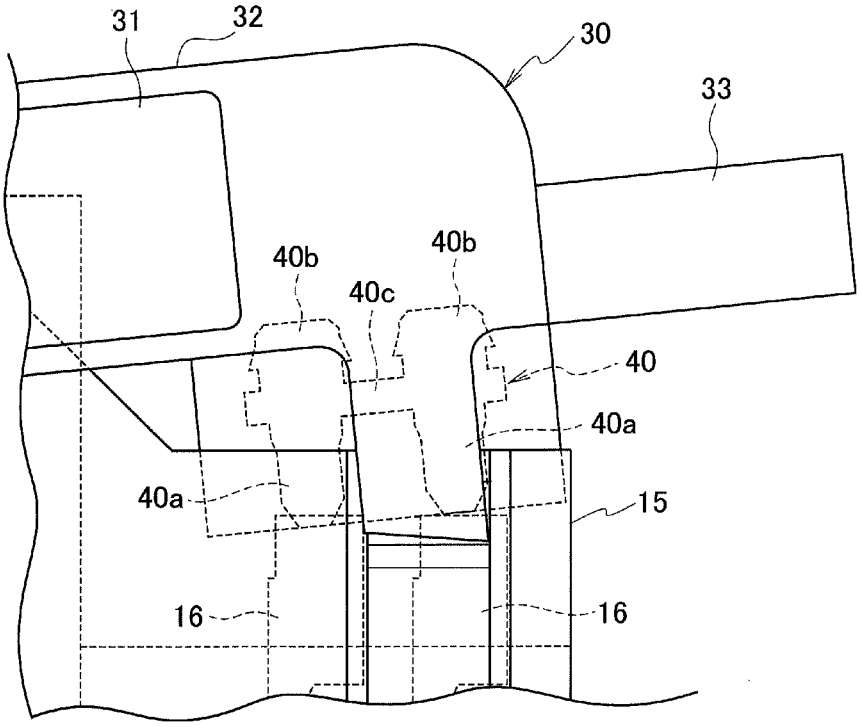
FIG. 14 is an enlarged side view of FIG. 13.

Next, conduction operations of the power source circuit by the power source circuit shutoff apparatus 1 will be explained, referring to FIG. 5 to FIG. 8, FIG. 13 and FIG. 14. FIG. 13 is a side view showing a state immediately before the first signal terminal 16 is mated with the second signal terminal 40 according to the embodiment. FIG. 14 is an enlarged side view of FIG. 13.

First, as shown in FIG. 5, as the connector mating start position of the lever 30, the second connector housing 20 is aligned with the connector mating chamber 10*a* of the first connector housing 10. Then, as shown in FIG. 6, the second connector housing 20 is inserted into the connector mating chamber 10*a* of the first connector housing 10, and the cam pin 11 is inserted into the entry straight portion 35*a* of the cam groove 35 of the lever 30. The first connector housing 10 and the second connector housing 20 are brought into a connector temporary mating state. In this case, the pair of the first main terminals 13 and the pair of the second main terminals 23 are brought into an off-state together, and the pair of first signal terminals 16 and the pair of the second signal terminals 40 are also brought into an off-state.

Next, as shown in FIG. 7, the lever 30 is caused to rotate from the connector mating start position to the connector mating completion position side. Then, the cam pin 11 moves in the cam groove 35 to thereby cause the mating force to the first connector housing 10 and the second connector housing 20, so that the second connector housing 20 is gradually inserted into the connector mating chamber 10*a* of the first connector housing 10.

Then, the lever 30 is rotated to the connector mating operation position, to thereby bring the first connector housing 10 and the second connector housing 20 into a complete mating state. In the process from the connector mating operation position to the connector mating completion position, the pair of first main terminals 13 and the pair of second main terminals 23 are brought into the on-state, thus bringing the main circuit switch SW1 into the on-state. In this case, the pair of first signal terminals 16 and the pair of second signal terminals 40 are in the off-state.

As shown in FIG. 13 and FIG. 14, further rotating the lever 30 to the connector mating completion position side causes one (left in FIG. 13 and FIG. 14) of the first signal terminals 16 and one (left in FIG. 13 and FIG. 14) of the second signal terminals 40 to have a contact with each other and then causes the other (right in FIG. 13 and FIG. 14) of the first signal terminals 16 and the other (right in FIG. 13 and FIG. 14) of the second signal terminals 40 to have a contact with each other.

Then, as shown in FIG. 8, rotating the lever 30 up to the connector mating completion position locks the first locking portion 37 to the first locked portion 17. In the rotation of the lever 30 from the connector mating start position to the connector mating completion position, after the pair of first main terminals 13 and the pair of second main terminals 23 are brought into the on-state, the contact between the pair of first signal terminals 16 and the pair of second signal terminals 40 is brought into the on-state, to thereby bring the signal circuit switch SW2 into the on-state. Further, the power source circuit is non-conductive with the lever 30 in the connector mating operation position and then is at last brought into a conductive state with the lever 30 in the connector mating completion position.

(4.2) Power Source Shutoff Operation of Power Source Circuit

Next, power source shutoff operations of the power source circuit by the power source circuit shutoff apparatus 1 will be explained with reference to FIG. 5 to FIG. 8, FIG. 13 and FIG. 14.

First, as shown in FIG. 8, with the lever 30 in the connector mating completion position, the lever 30 is rotated to the connector mating start position side by a rotational force greater than a lock force between the first locked portion 17 and the first locking portion 37. Then, the locking between the first locked portion 17 and the first locking portion 37 is unlocked, to thereby allow the lever 30 to rotate. As shown in FIG. 7, this makes the lever 30 rotatable in the connector completion mating operation position.

In the process of rotating the lever 30 from the connector mating completion position to the connector mating operation position, as shown in FIG. 13 and FIG. 14, the contact between the other (right in FIG. 13 and FIG. 14) of the first signal terminals 16 and the other (right in FIG. 13 and FIG. 14) of the second signal terminals 40 is canceled, and then the contact between the one (left in FIG. 13 and FIG. 14) of the first signal terminals 16 and the one (left in FIG. 13 and FIG. 14) of the second signal terminals 40 is canceled. Thus, with the lever 30 in the connector mating operation position, the signal circuit switch SW2 is brought into the off-state. This makes the power source circuit non-conductive when the lever 30 is in the connector mating operation position.

Next, when the lever 30 rotates up to the connector mating start position, the cam pin 11 and the cam groove 35 together cause a separating force to the first connector housing 10 and the second connector housing 20, to thereby gradually pull out the second connector housing 20 from the connector mating chamber 10*a* of the first connector housing 10.

As shown in FIG. 6, with the lever 30 in the connector mating start position, the first connector housing 10 and the second connector housing 20 are brought into the temporary mating state. The contact between the first main terminals 13 and the second main terminals 23 is gradually canceled in the process from the connector mating operation position to the connector mating start position, and then the first main terminals 13 and the second main terminals 23 are completely brought into a non-conductive state in the connector mating start position. That is, with the lever 30 rotated from the connector mating completion position to the connector mating start position, after the contact between the pair of first signal terminals 16 and the pair of second signal terminals 40 is brought into the off-state, the pair of first main terminals 13 and the pair of second main terminals 23 are brought into the off-state, to thereby bring the main circuit switch SW1 into the off-state.

(5) Operations and Effects

According to the embodiment, each of the pair of first signal terminals 16 and the pair of second signal terminals 40 are disposed along the straight line L extending in the direction perpendicular to the rotational spindle direction of the lever 30 with the interval from each other. Thus, rotation of the lever 30 from the connector mating start position to the connector mating completion position causes the one of the first signal terminals 16 and the one of the second signal terminals 40 to have a contact with each other and, then, causes the other of the first signal terminals 16 and the other of the second signal terminals 40 to have a contact with each other. This can disperse the force for rotating the lever 30, thus enabling to improve the operability of the lever 30.

Further, with the lever 30 rotated from the connector mating completion position to the connector mating start position, the contact between the other of the first signal terminals 16 and the other of the second signal terminals 40 is canceled, and then the contact between the one of the first signal terminals 16 and the one of the second signal terminal 40 is canceled. This allows the signal circuit switch SW2, which includes the pair of first signal terminals 16 and the pair of second signal terminals 40, to be more rapidly brought into the off-state. Thus, an arc discharge caused between the pair of first main terminals 13 and the pair of second main terminals 23 can be suppressed.

According to the embodiment, the pair of first signal terminals 16 and the pair of second signal terminals 40 are disposed along the straight line L extending in the direction perpendicular to the rotational spindle direction of the lever 30. This eliminates the need of bending the pair of second signal terminals 40, unlike the conventional technology, and can shorten the length (connecting portion 40*c*) between the pair of second signal terminals 40, thus enabling to reduce the production cost of the pair of second signal terminals 40.

According to the embodiment, each of the pair of first main terminals 13 and the pair of second main terminals 23 are disposed along the straight line L extending in the direction perpendicular to the direction of the rotational spindle direction of the lever 30 with the interval from each other. This can narrow the width of each of the first connector housing 10 and the second connector housing 20 relative to the rotational spindle direction of the lever 30, thus enabling to increase a degree of freedom of the power source circuit shutoff apparatus 1.

According to the embodiment, the operating portion 33 is provided closer to the rotational distal end side than to the position of the pair of second signal terminals 40. This can narrow the width of the lever 30 relative to the rotational spindle direction of the lever 30, thus increasing the degree of freedom of the power source circuit shutoff apparatus 1.

(6) Modified Example

Figure 15:
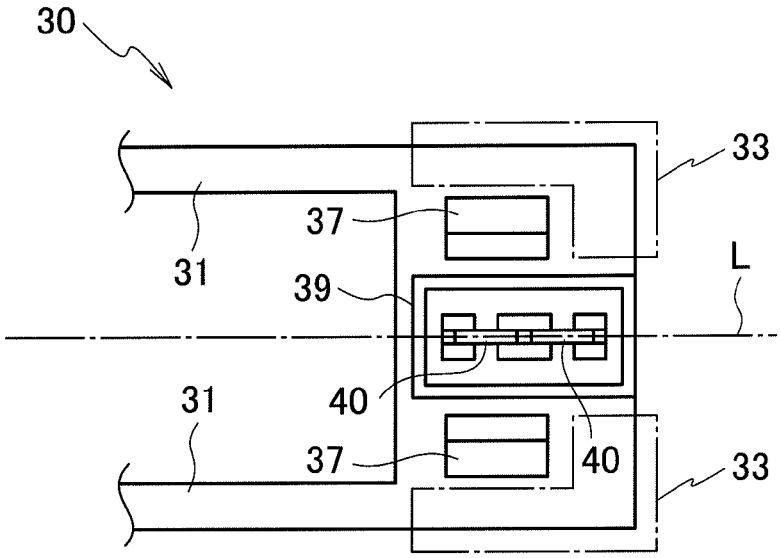
FIG. 15 is a plan view showing a part (near the second signal terminal 40) of the lever 30 according to a modified example of the embodiment of the present invention.

Next, the power source circuit shutoff apparatus 1 according to a modified example of the embodiment will be explained with reference to the drawings. FIG. 15 is a plan view showing a part (near the second signal terminal 40) of the lever 30 according to the modified example. Further, same reference numerals or signs will be assigned to same portions as those of the power source circuit shutoff apparatus 1 according to the embodiment set forth above, and different portions will be mainly explained.

According to the embodiment, the operating portion 33 is provided closer to the rotational distal end side than to the position of the pair of second signal terminals 40. Contrary to this, according to the modified example, as shown in FIG. 15, the operating portion 33 is provided on a lateral side of the pair of second signal terminals 40 (that is, the rotational spindle direction side of the lever 30).

According to the modified example, the operating portion 33 is provided on the lateral side of the pair of second signal terminals 40. This can shorten the length of the lever 30 relative to the direction perpendicular to the rotational spindle direction of the lever 30, thus enabling to increase the degree of freedom of the power source circuit shutoff apparatus 1.

(7) Other Embodiment

As described above, the contents of the present invention have been disclosed according to the embodiments. However, the explanations and drawings constituting a part of this disclosure shall not limit the present invention. From this disclosure, various alternative embodiments, examples and operational technologies will be obvious to a person skilled in the art.

For example, the embodiment can be changed in the following manner. Specifically, it is not necessary for the pair of first main terminals 13 to be disposed in a line-up manner along the straight line L, but they may be so disposed as to oppose each other. Likewise, it is not necessary for the pair of second main terminals 23 to be disposed in a line-up manner along the straight line L, but they may be so disposed as to oppose each other.

Further, it is not necessary for the pair of first signal terminals 16 (openings 16*c*) to be disposed in a line-up manner along the straight line L, provided that the first signal terminals 16 are disposed along the straight line L with the interval from each other. For example, the pair of first signal terminals 16 may be so disposed as to oppose each other. Likewise, it is not necessary for the pair of second signal terminals 40 to be disposed in a line-up manner along the straight line L, provided that the second signal terminals 40 are disposed along the straight line L with the interval from each other. For example, the pair of second signal terminals 40 may be so disposed as to oppose each other.

As set forth above, it is a matter of course that the present invention includes various other embodiments not described herein. Thus, the technical scope of the present invention is defined only by the inventive specific matters according to the scope of claims which is proper from the above explanations.

What is claimed is:

1. A power source circuit shutoff apparatus comprising:

a first connector housing having a pair of first main terminals and a pair of first signal terminals;

a second connector housing having a pair of second main terminals configured to be mated with and separated from the pair of the first main terminals, the second connector housing being configured to be mated with and separated from the first connector housing; and a lever having a pair of second signal terminals configured to be mated with and separated from the pair of the first signal terminals, the lever being rotatably provided at the second connector housing and configured to cause a mating force or a separating force to the first connector housing and the second connector housing by a rotation, wherein with the lever rotated from a connector mating start position to a connector mating completion position, after the pair of the first main terminals and the pair of the second main terminals are brought into an on-state, the pair of the first signal terminals and the pair of the second signal terminals are brought into an on-state, with the lever rotated from the connector mating completion position to the connector mating start position, after the pair of the first signal terminals and the pair of the second signal terminals are brought into an off-state, the pair of the first main terminals and the pair of the second main terminals are brought into an off-state, the pair of the first signal terminals are disposed directly on a straight line extending in a direction perpendicular to a rotational spindle direction of the lever with an interval from each other, and the pair of the second signal terminals are disposed directly on the straight line with an interval from each other.

2. The power source circuit shutoff apparatus according to claim 1 wherein the pair of the first main terminals are disposed along the straight line with an interval from each other, and the pair of the second main terminals are disposed along the straight line with an interval from each other.

3. The power source circuit shutoff apparatus according to claim 1 wherein the lever includes an operation portion capable of operating the rotation of the lever, and the operation portion is provided closer to a rotational distal end side than to a position of the pair of the second signal terminals.

4. The power source circuit shutoff apparatus according to claim 1 wherein the lever includes an operation portion capable of operating the rotation of the lever, and the operation portion is provided on a lateral side in a position of the pair of the second signal terminals.

5. The power source circuit shutoff apparatus according to claim 1, wherein a width direction of the pair of the first main terminals is along the straight line, and a width direction of the pair of the second main terminals is along the straight line.

* * * * *